US005400557A

United States Patent [19]

Glover

[11] Patent Number: 5,400,557

[45] Date of Patent: Mar. 28, 1995

[54] WINDOW UNIT

[76] Inventor: J. Raymond Glover, 1019 Ave. C, White City, Jackson County, Oreg. 97503

[21] Appl. No.: 975,097

[22] Filed: Nov. 12, 1992

[51] Int. Cl.[6] ..... E06B 1/08

[52] U.S. Cl. ..... 52/201; 49/339; 49/341; 52/204.1

[58] Field of Search ..... 52/201, 204.1; 49/339, 49/341

[56] References Cited

U.S. PATENT DOCUMENTS

| | | | |
|---|---|---|---|
| 280,946 | 7/1883 | Nordyke | 52/201 |
| 601,104 | 3/1898 | Rixson | 49/341 |
| 834,410 | 10/1906 | Rosenheim et al. | 49/341 |
| 1,152,899 | 9/1915 | Moore | 52/201 |
| 1,214,057 | 1/1917 | Moore | 52/201 |
| 1,686,587 | 10/1928 | Weiss | 49/339 X |
| 4,030,258 | 6/1977 | Anders | 52/212 X |
| 4,090,339 | 5/1978 | Anderson | 52/406 X |
| 4,791,771 | 12/1988 | Haugaard et al. | 52/727 X |
| 4,799,727 | 1/1989 | Robbins et al. | 16/225 X |
| 5,063,717 | 11/1991 | Quaranta et al. | 52/201 |

FOREIGN PATENT DOCUMENTS

| | | | |
|---|---|---|---|
| 65043 | 3/1892 | Germany | 49/341 |

OTHER PUBLICATIONS

"How to Make the Most of a Sunny Window", color brochure by KSI Building Products, Inc.

"Casement 45° Angle Bay Windows", Casement 90° Box Bay Windows, Casement Bow and Angle Bay Details and Awning Windows, color borchure by Andersen Windows.

"Mohr Garden Window Model #7654", Mohr Garden Window Model #4454, Mohr Garden Window Model #6044, Standard Features and Optional Glass Shelf, brochure by Mohr® Garden Window Co., and Installation Instructions for Mohr Garden Windows.

"Nothing Finishes Off a House Like a Nice, Big Bow", We've Got All the Angles, color brochure by Marvin Windows.

*Primary Examiner*—Lloyd A. Gall

*Attorney, Agent, or Firm*—Richards, Medlock & Andrews

[57] ABSTRACT

A bay window unit has sidewalls interconnected by a front wall and a top. A glass pane is positioned in the sidewalls and each sidewall has upper and lower rails and side rails surrounding the glass pane. A shear panel comprising a continuous sheet of material is overlayed and bonded to the upper and lower rails and side rails of each sidewall. The unit is attached to vertical studs and is cantilevered therefrom with one face of each sidewall overlapping and extending between confronting faces of the studs. The window unit has a pivotable sash mounted to the top which is operated by a linkage concealed by one of the shear panels.

15 Claims, 7 Drawing Sheets

FIG. 5
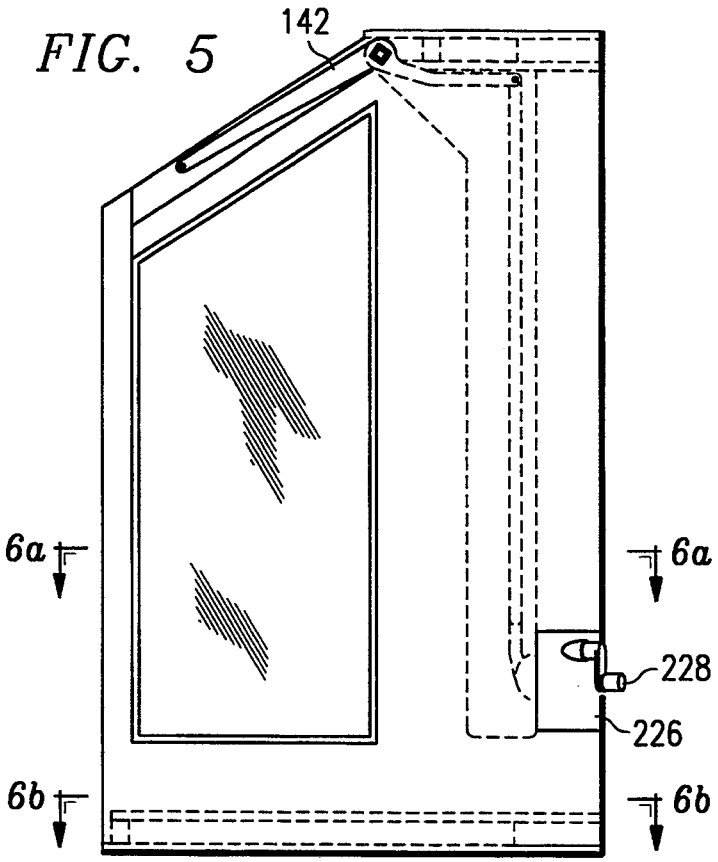
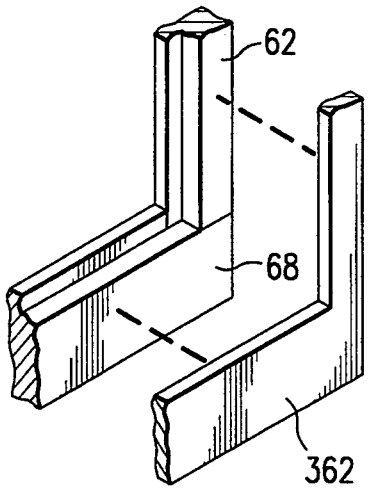
FIG. 6c
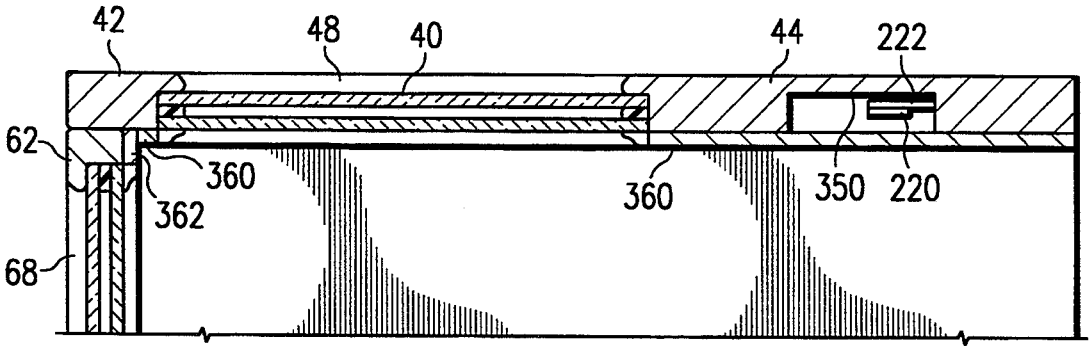
FIG. 6a
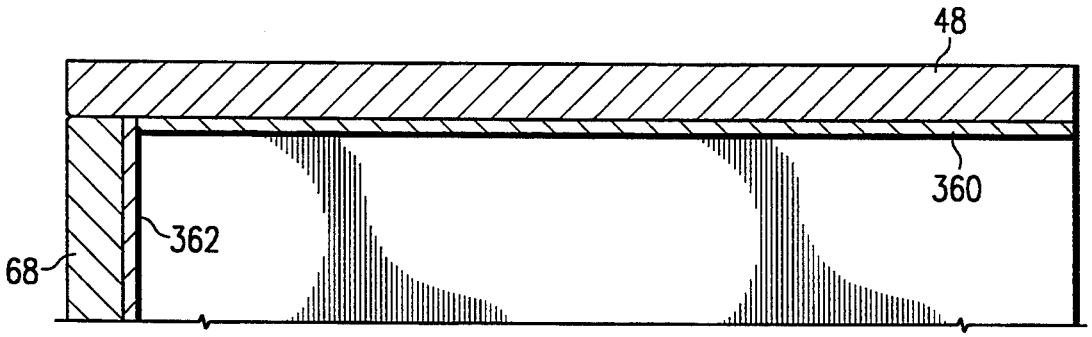
FIG. 6b

WINDOW UNIT

TECHNICAL FIELD OF THE INVENTION

The present invention relates to a window unit and more specifically to a window unit having an improved structural design which facilitates installation and a pivotable top sash which is actuated by linkage concealed in the sidewall of the unit.

BACKGROUND OF THE INVENTION

Bay windows have been used in remodeling and new construction for many years. By virtue of their design, bay windows add an aesthetically pleasing appearance while functioning to introduce additional light into a room. Additionally, bay windows provide additional space by virtue of the extension of the bay window exteriorly of the wall in which the bay window is installed.

Past and present bay window designs have normally required substantial time and labor to construct and install. Several bay windows are presently marketed for use in remodeling of existing structures. In these designs, a substantially complete bay window assembly is provided and installation is accomplished by affixing the unit to the face of the remodeled structure. In many cases, this requires the removal of siding and/or brick veneer and the attachment of a frame perimeter to which the bay window is attached. In other instances, because of the weight and design of the bay window, braces must be attached to the wall structure below the window to provide support. In still other cases, cables must be attached from the roof overhang to support the bay window from above.

In past and present bay window designs, the glass to wood ratio is reduced by the requirement that bulky vertical and horizontal rails be used to provide sufficient rigidity and strength to the unit. This construction makes these units heavier and therefore more difficult to install and to properly support. Further, these designs lose the aesthetic benefit which is achieved by increasing the glass area in relationship to the frame components.

Past and existing units have failed to provide a design having an openable sash, whether at the top or sides, which is easy to open and close and yet does not require exposure within the window of operating arms or other hardware.

Thus, a need exists for a bay window which is both easy to install and does not require complicated and expensive modification to existing structures for installation. Moreover, a need exists for a bay window which does not require braces or cables to support the bay window from the new or remodeled structure. Further, a need exists for a bay window which has an openable sash that may be easily operated from the inside without the need for exposed operating arms and hardware which obstruct the view through the window.

SUMMARY OF THE INVENTION

The present invention eliminates the deficiencies heretofore existing and enumerated above. In accordance with one embodiment of the invention, a bay window unit comprises sidewalls interconnected by a front, a bottom and a top section. A glass pane is positioned in the sidewalls and in the front of the unit. Each sidewall has upper and lower rails and side rails surrounding the glass pane. A shear panel comprising a continuous sheet of multi-ply or synthetic material is overlaid and bonded to the upper and lower rails and side rails of each sidewall. By the use of such continuous sheets to form a shear panel and by joining such constructed sidewalls to the front and bottom of the bay window, a surprisingly rigid unitary structure is achieved. Additionally, the sidewalls are designed to have sufficient depth to facilitate installation. Specifically, the sidewalls have a sufficient extension such that they may be positioned within and overlying the confronting faces of wall studs for attachment thereto. In one embodiment of the invention, the shear panels for the sidewalls extend continuously over such sidewall extensions to further add rigidity to the assembly.

Attachment of the bay window to the structure is accomplished by using fasteners which extend through the sidewalls and into the face of vertical studs which make up the wall of the construction to which the bay window is attached. In this way, the bay window is cantilevered from the wall studs. In view of the integrated structure of the bay window, and the rigidity which is achieved by using the construction according to the present invention, such cantilevered attachment is all the attachment needed for the installation of the window unit. Therefore, no bracing from below the unit is necessary, nor are cables extending from above required.

In accordance with a further embodiment of the invention, a pivotable sash is mounted to and forms a part of the top of the window unit. This pivotable sash has a glass pane therein surrounded by a wooden frame. An operating linkage extends from the pivotable sash and is concealed at least partially within the sidewall of the window unit. The linkage provides for pivoting the sash relative to the sidewalls and includes an operating mechanism mounted for exposure and activation on the interior of one sidewall of the bay window. In accordance with one embodiment of the invention, the linkage comprises a crank mechanism for rotating a crank arm, an actuation bar attached to the crank arm for movement with the crank arm, and a pivot arm having first and second ends with the first end attached to the activation bar. A torque bar is attached to the second end of the pivot arm and bearing assemblies are mounted to the window unit for receiving the ends of the torque bar. A pair of lift arms are attached to opposite ends of the torque bar and rollers on the ends of the lift arms engage the pivotable top sash to raise and lower the sash as the crank mechanism is rotated.

In accordance with a further embodiment of the invention, a flexible, solid continuous hinge is mounted between the movable sash and the top of the window unit. The hinge is formed from a flexible material, such as silicon, which is extremely weather resistant yet sufficiently flexible to serve as a connecting hinge between the top sash and the bay window. In accordance with a further embodiment of the invention, the hinge is attached between the movable top sash and a removable mounting rail which is attached to the top of the window unit. In this configuration, removal of the top sash, for repair or replacement, is easily achieved by simply removing the mounting rail to which the top sash and hinge are attached. Replacement of a new top sash, hinge and mounting rail to the top of the window unit can be achieved to thereby accomplish replacement of the top sash if necessary.

In accordance with a further embodiment of the invention, the actuation bar and crank arm of the linkage for operating the pivotable top sash are concealed within one of the sidewalls. In accordance with this embodiment, the actuation bar and crank arm are concealed from view below the shear panel which forms a part of the sidewall.

By virtue of the construction used, the present invention provides a bay window which is designed to produce a unitary, rigid structure which may be attached to and cantilevered from vertical studs in either existing or new construction without the need for braces supporting the unit from below or support cables extending from above the unit. Such rigidity is in part accomplished by the use of shear panels which are mounted to form a part of the sidewalls of the unit. Further, a movable sash is actuated by a mechanism having actuation linkages concealed below the shear panel. Because the bay window is attached by positioning the sidewalls inwardly overlaying the side face of vertical studs making up the wall structure to which the unit is attached, the actuation mechanism may therefore be positioned to be readily accessible to the user. Thus, the present invention provides a bay window having structural strength, simplified installation, beauty and convenience of operation.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIG. 5 is a vertical section view looking from the interior of the bay window;

FIG. 6*a* is a section view taken along line 6*a*—6*a* of FIG. 5;

FIG. 6*b* is a vertical section view taken along line 6*b*—6*b* of FIG. 5;

FIG. 6*c* is a perspective view from the inside showing the shear panel attachment to the side and top rails of the bay window front;

DETAILED DESCRIPTION

Figure 1:
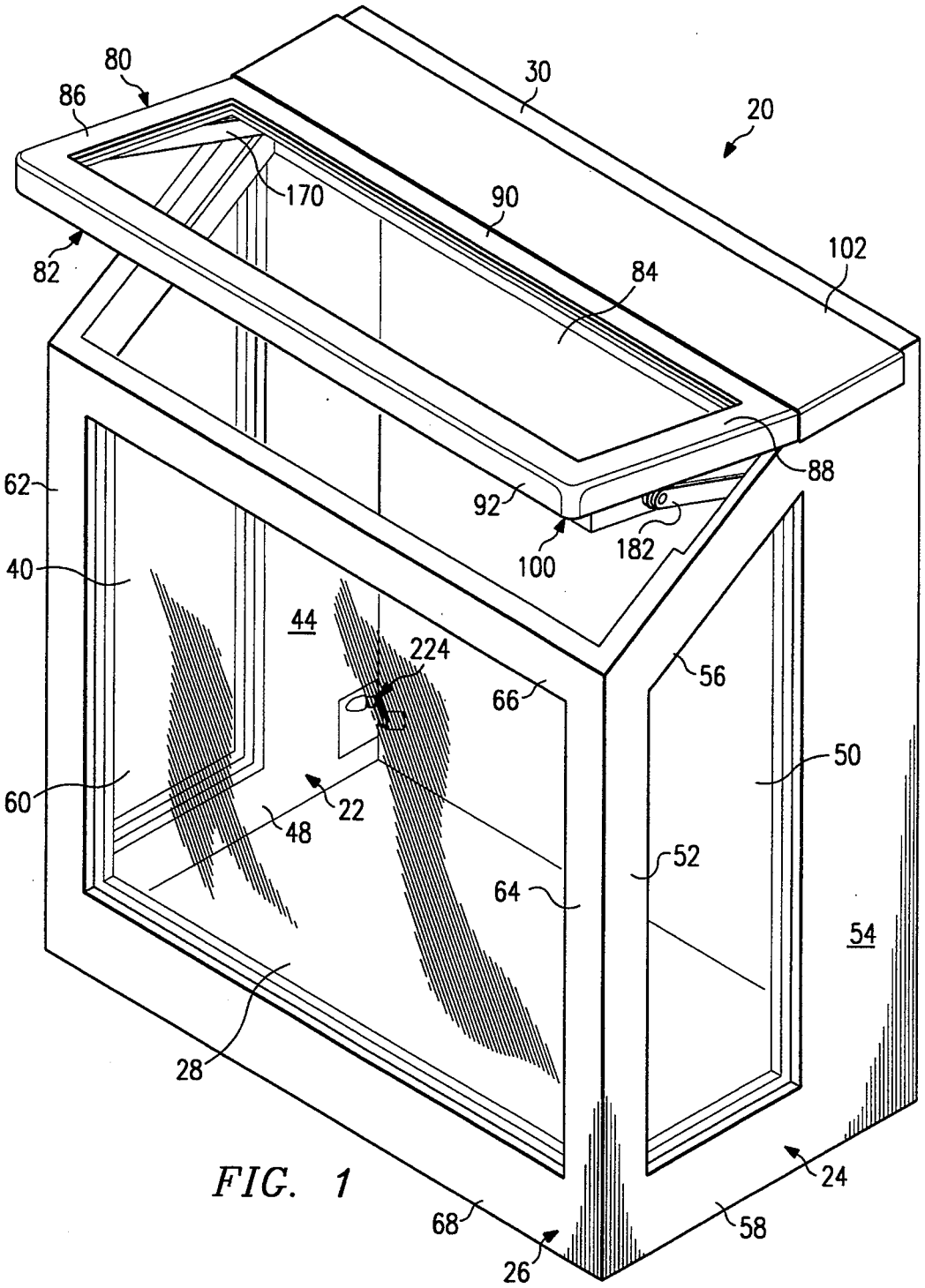
FIG. 1 is a perspective view of the bay window according to the present invention with the top sash in the open position.

Referring to FIG. 1, the bay window 20 according to the present invention includes a right sidewall 22 and a left sidewall 24 maintained in a spaced, parallel position by a front 26, a bottom 28 and a top 30. Sidewall 22 has a glass pane 40 which is positioned within a frame having side rails 42 (FIG. 3) and 44 joined to upper and lower rails 46 and 48, respectively. Similarly, sidewall 24 has a glass pane 50 positioned within a frame having side rails 52 and 54 and top and bottom rails 56 and 58, respectively. Front 26 has a glass pane 60 supported within a frame having side rails 62 and 64 and top and bottom rails 66 and 68, respectively. Top 30 joins the upper ends of rails 44 and 54 at sidewalls 22 and 24, respectively. Bottom 28 joins the lower edges of sidewalls 22 and 24 and front 26.

Figure 3A:
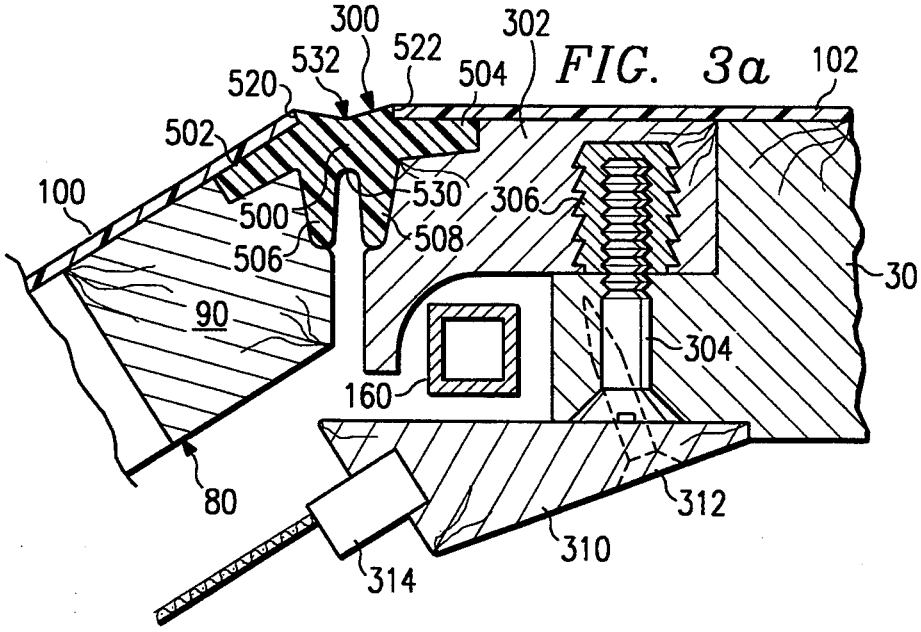
FIG. 3*a* is an enlarged section view showing the area designated as 3*a* in FIG. 3.

Referring still to FIG. 1, a pivotable sash 80 is joined to top 30. Sash 80 includes a frame 82 surrounding a glass pane 84. Frame 82 has side rails 86 and 88 joined and maintained in a parallel, spaced position by upper and lower rails 90 and 92, respectively. Pivotable sash 80 has a vinyl glazing cap 100 (also shown in FIG. 3*a*) positioned thereover and attached by an appropriate adhesive. A vinyl covering 102, shown in FIGS. 1 and 3*a*, is also positioned over top 30.

Figure 2:
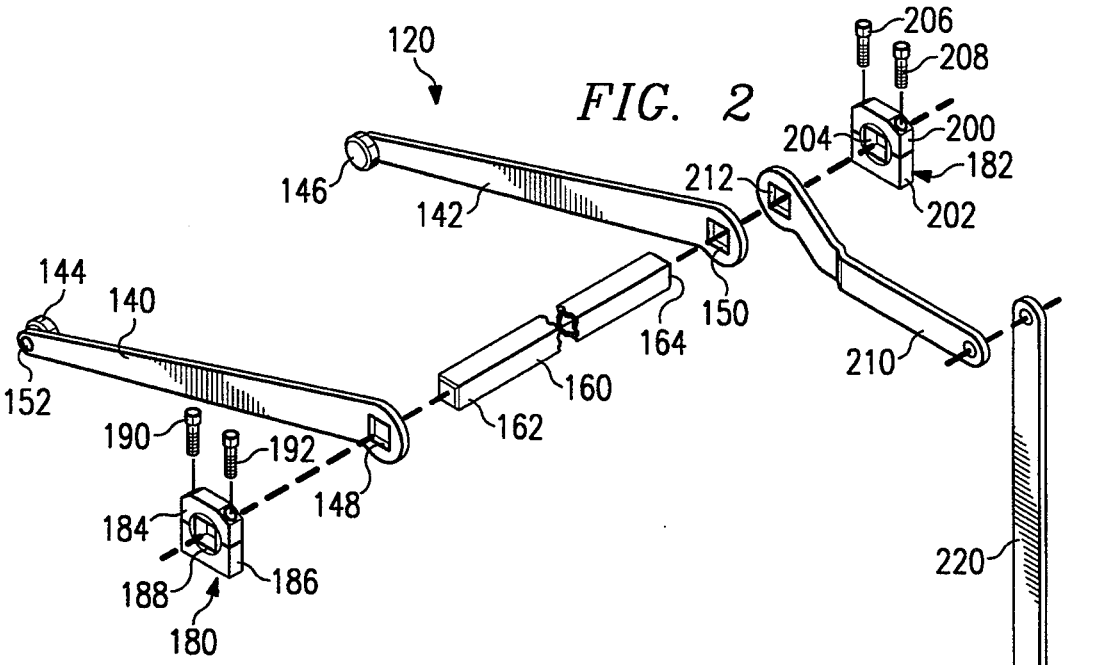
FIG. 2 is a perspective view of the actuation linkage used to open and close the top sash.

Referring both to FIG. 1 and FIG. 2, pivotable sash 80 is opened and closed by being raised and lowered using lift linkage and actuation assembly 120. Assembly 120 includes a pair of lift arms 140 and 142, each having a roller 144 and 146, respectively, at one end and a square aperture 148 and 150, respectively, at the other end. Rollers 144 and 146, which may be made of nylon or plastic, have a shaft 152 for attachment to lift arms 140 and 142. A torque bar 160 interconnects the ends of lift arms 140 and 142 at apertures 148 and 150. Torque bar 160 is square in cross-section and has ends 162 and 164 for registering with apertures 148 and 150 in lift arms 140 and 142, respectively. Ends 162 and 164 are received in bearing inserts 188 and 204, respectively, in bearing assemblies 180 and 182. Bearing assembly 180 includes upper and lower halves 184 and 186, respectively, with bearing insert 188 captured therebetween. The halves of the bearing assembly are held together and the bearing assembly is mounted in sidewall 24 by appropriate fasteners 190 and 192. Similarly, bearing assembly 182 has upper and lower halves 200 and 202 with bearing insert 204 therein. The halves of bearing assembly 182 are held together to capture bearing insert 204 and are mounted to sidewall 22 by appropriate fasteners 206 and 208.

An actuation arm 210 is captured between lift arm 142 and bearing assembly 182. Actuation arm 210 has one end with a square aperture 212 for receiving the square end of bushing 164 therethrough. The opposite end of actuation arm 210 is pivotally pinned to a connecting rod 220. The end of connecting rod 220 opposite actuation arm 210 is in turn pivotally pinned to a crank arm 222 which is pivoted by a crank mechanism 224. Crank mechanism 224 has a gear box 226 and a handle 228 for rotating gears (not shown) to pivot crank arm 222 to raise and lower connecting rod 220.

Figure 3B:
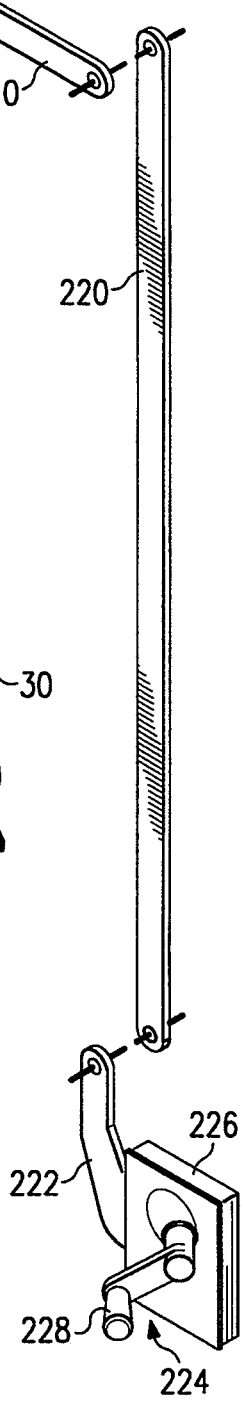
FIG. 3*b* is a section view taken along line 3*b*—3*b* of FIG. 3.
Figure 3B:
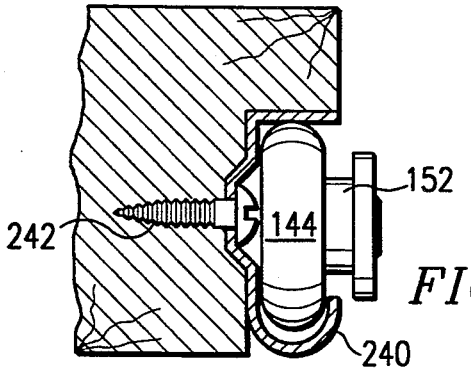

Rollers 144 and 146 engage pivotable sash 80 to raise and lower the sash as the lift linkage and actuation assembly 120 is operated. Specifically, and referring to FIG. 3*b* in conjunction with FIG. 1, a J-track 240 is mounted on each side edge of pivotable sash 80 with a plurality of wood screws 242 as shown. J-track 240 is contoured along its lower edge to correspond to the contours of rollers 144 and 146 which ride therein.

As can be seen from the linkage shown in FIG. 2, lift arms 140 and 142 are raised and lowered by the rotation of handle 228 of gear box 226. Lift arms 140 and 142 are rotated upwardly by rotating handle 228 to pivot crank arm 222 downwardly. As crank arm 222 moves downwardly, connecting rod 220 and actuation arm 210 move downwardly to rotate torque bar 160 thereby transmitting such rotating through bearing assemblies 180 and 182 and to lift arms 140 and 142 by virtue of the registration of the torque bar to such lift arms. Rollers 144 and 146 move within J-tracks 240 positioned on each side of pivotable sash 80 to raise the sash. The sash is lowered by rotating handle 228 in a reverse direction.

As can be seen in FIG. 3*a*, pivotable sash 80 is connected to top 30 by a continuous flexible hinge 300 which extends the full span of sash 80. In one embodiment, hinge 300 is made from silicon, having 60 durometer, shore A. This material has superior weathering resistance and experiences little degradation from ozone or UV radiation. Hinge 300 has a uniform cross-section of the shape shown in FIG. 3*a*, and provides a fluid tight connection between pivotable sash 80 and top 30. Hinge 300 is connected between upper rail 90 of the pivotable sash and a removable hinge rail 302 using appropriate means such as adhesive and staples. The hinge rail 302 is connected to top 30 by a plurality of fasteners 304 received within threaded inserts 306. A screen support 310 is attached to top 30 by appropriate fasteners 312. Screen 314 is held in position as shown in FIG. 3*a*.

Hinge 300 has a unique design which facilitates attachment between pivotal sash 80 and hinge rail 302 to assure a secure attachment and to provide a fluid tight seal therebetween while serving as a hinge. Referring specifically to FIG. 3*a* which shows a cross-section of hinge 300, the hinge includes a thick mid-section 500 having upper ears 502 and 504 extending therefrom. A pair of downwardly extending legs 506 and 508 are also formed from mid-section 500. As can be seen, leg 506 is separated from ear 502 by approximately a 90° angle. Similarly, ear 504 is separated from leg 508 by approximately a 90° angle. The juncture between legs 506 and 508 is radiused at 530 to equally distribute stresses in this flexure area. Similarly, the upper surface 532 of hinge 300 is slightly creased to facilitate hinging.

Ear 502 is attached in a rabbeted recess formed in the top of rail 90 and leg 506 is attached in a rabbeted recess formed in the end of rail 90. Similarly, ear 504 is attached to a rabbeted recess along the upper surface of hinge rail 302 and leg 508 is attached in a rabbeted recess formed along the edge of hinge rail 302. A step 520 is formed in the top surface of hinge 300 with the edge of vinyl cap 100 abutting thereagainst. Similarly, a step 522 is formed along the upper surface of ear 504 to receive the edge of vinyl cap 102 thereagainst. This geometry provides for a very tough hinge structure while assuring a positive, continuous fluid tight seal between sash 80 and top 30.

It can be appreciated that because the angle of movement required by the hinge is on the order of less than 45°, the use of a flexible material, such as silicon, in this hinge location is ideal and produces unexpectedly superior results. Alternatively, other materials may also be used for hinge 300 such as EPDM (ethylene propylene diamine polymer).

The positioning of the lift linkage and actuation assembly 120 within sidewall 22 is shown in FIGS. 3 through 6. These figures also show the unique shear panel construction which provides for the rigidity achieved by the present design. Referring first to FIGS. 3 through 6 for purposes of describing the construction of the wall structures, it can be seen that sidewall 22 includes side rails 42 and 44 connected at their opposite ends by upper rail 46 and lower rail 48. In one embodiment, these sidewalls are made from 1⅛" solid wood stock such as western cedar. An insulated, double glass pane 40 is mounted therein. Referring specifically to FIG. 6*a*, side rail 44 extends to facilitate attachment of the bay window, as will be described hereinafter in greater detail, and also has a milled out area 350 for receiving actuation arm 210, connecting rod 220 and crank arm 222.

Figure 3:
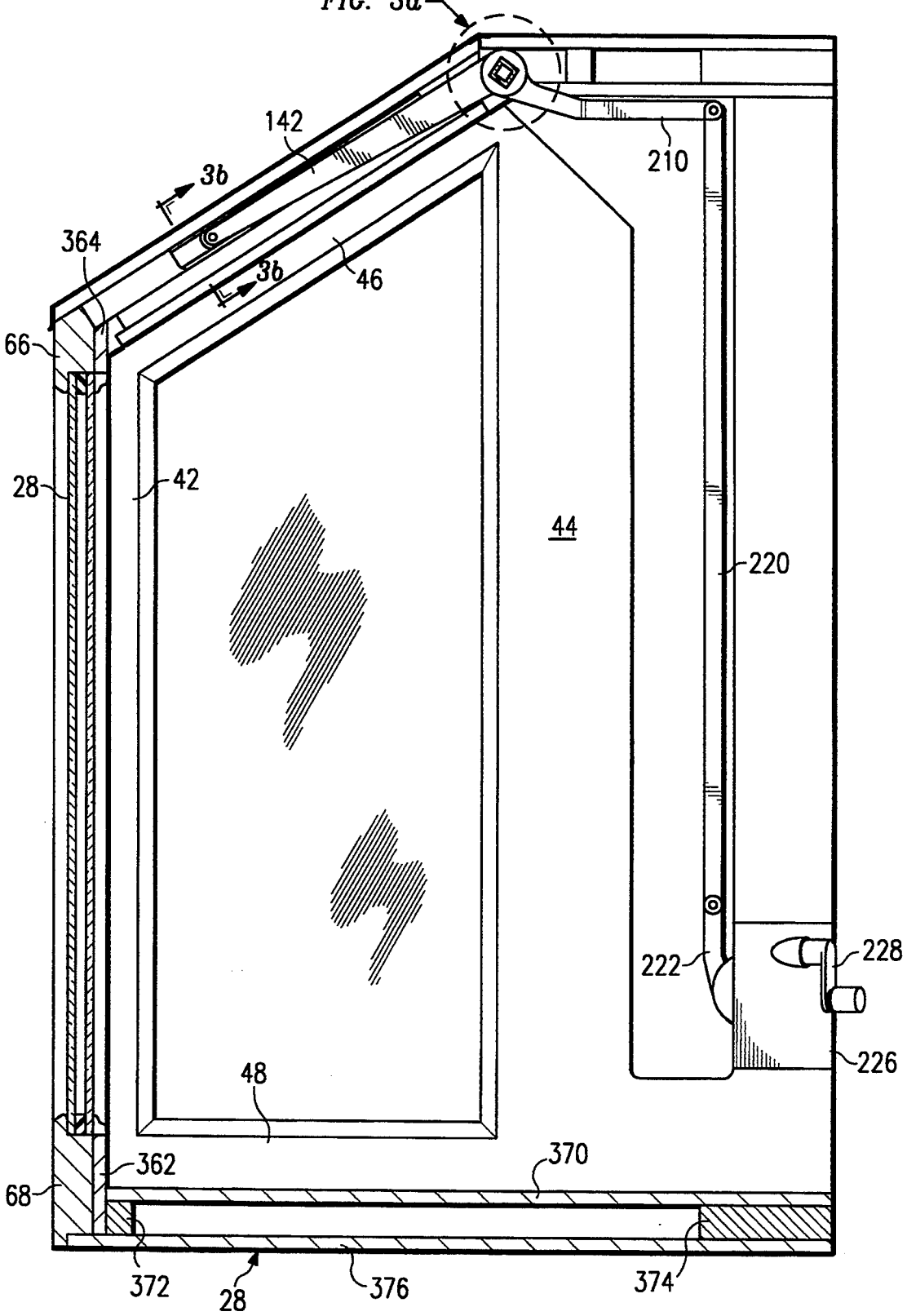
FIG. 3 is a vertical section view of the bay window shown in FIG. 1 with the top sash in the closed position.
Figure 4:
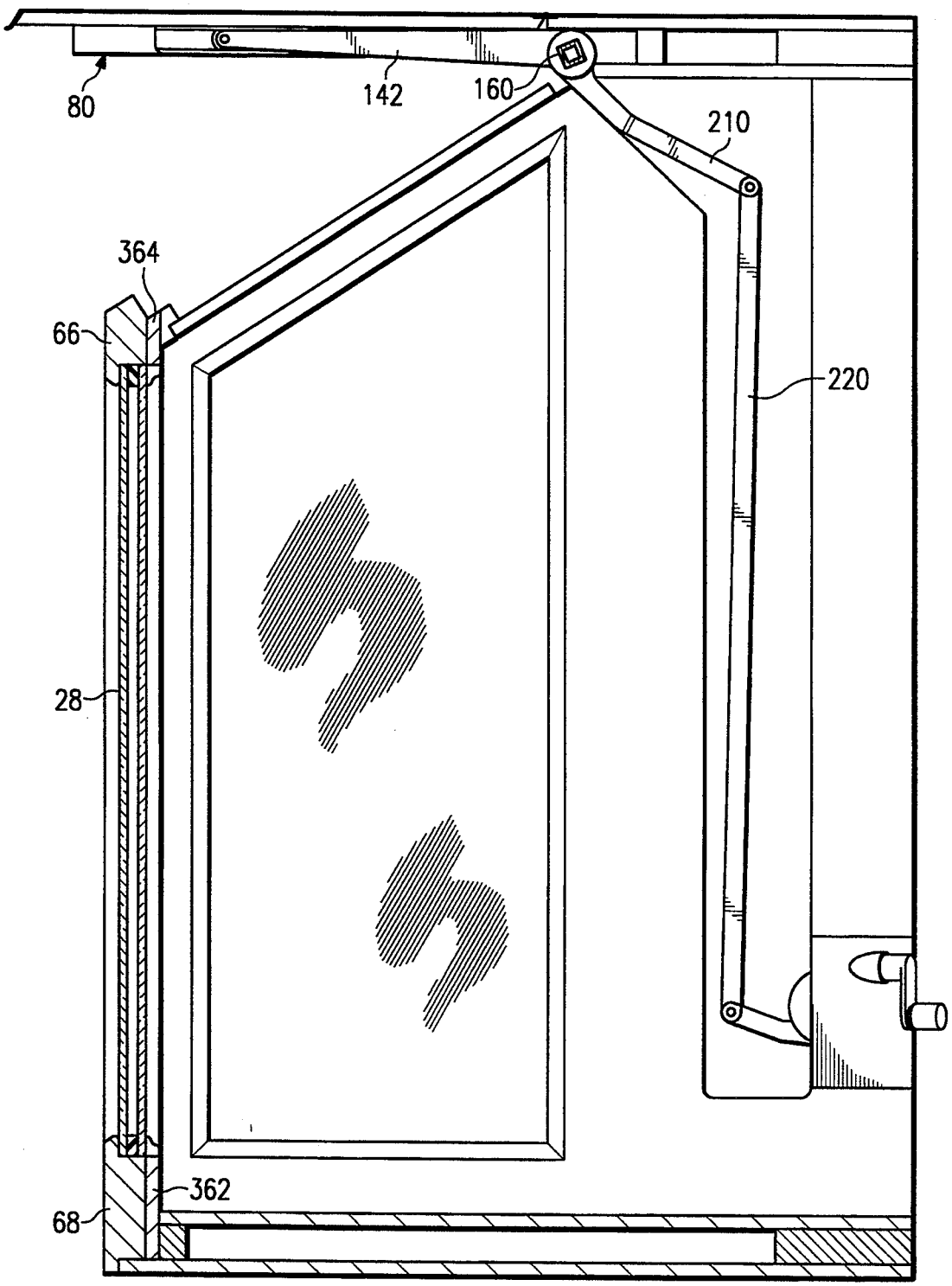
FIG. 4 is a vertical section view of the bay window shown in FIG. 1 with the top sash in the open position.

These components are concealed by the placement of a continuous shear panel 360 of 5/16" plywood which overlays both the side rails 42 and 44 and upper rail 46 and lower rail 48. As is shown in FIGS. 3, 4 and 6, a plywood shear panel 362 is attached to bottom rail 68 of front 26 and extends upwardly onto side rails 62 and 64, thereby overlaying the joints between these pieces to form a rigid, squared front. Similarly, a shear panel 364 is attached to top rail 66 of front 26 and extends downwardly onto side rails 62 and 68 thereby overlaying the joints between these pieces to form a rigid, squared front. Shear panels 362 and 364 prevent the front, and thereby the assembly, from rocking out of square alignment. FIG. 6*c* shows a typical corner construction of front 26 illustrating the relationship between shear panel 362, the side rails, and the top and bottom rails.

While in a preferred embodiment, the shear panels 360 and 362 are plywood, synthetic materials, such as ⅛" or greater ABS sheeting, can be substituted for plywood without departing from the invention. The use of a plywood or synthetic shear panel also permits the accommodation of unlimited interior finishes in that real wood veneers of any wood specie, or any synthetic material, can be used. Such variety would not be economically possible if the interior was finished in solid wood. Thus, the shear panels serve both a structured and aesthetic function.

Thus, the sidewalls 22 and 24, and front 26, while having a substantially large glass to wood ratio, and having relatively narrow side rails and top and bottom rails, have substantial rigidity added thereto by the use of shear panels described. Further, the complete assembly of the sidewalls to the front, bottom and top, produce a unitary structure which is surprisingly rigid. This is all accomplished while also providing a mechanism for raising and lowering the upper movable sash and at the same time concealing the mechanism used to accomplish this function. Moreover, the sidewall design permits the placement of the gear box 224 and crank handle 228 immediately adjacent to the rearmost portion of the bay window sidewall.

The construction of bottom 28 is also important to the overall structural integrity of the unit. Bottom 28 has an upper panel 370 to which a front rail 372 and a rear rail 374 is attached by staples and glue. A lower panel 376 is similarly attached to rails 372 and 374, and to runners (not shown) which extend between the front and rear rails 372 and 374 at spaced intervals. Insulation is added between panels 370 and 372 and between the runners. Panel 376 is attached, in the coped fashion show in FIG. 3, to each of the lower rails of the front and sides, to produce an integrated, rigid structure.

Figure 7:
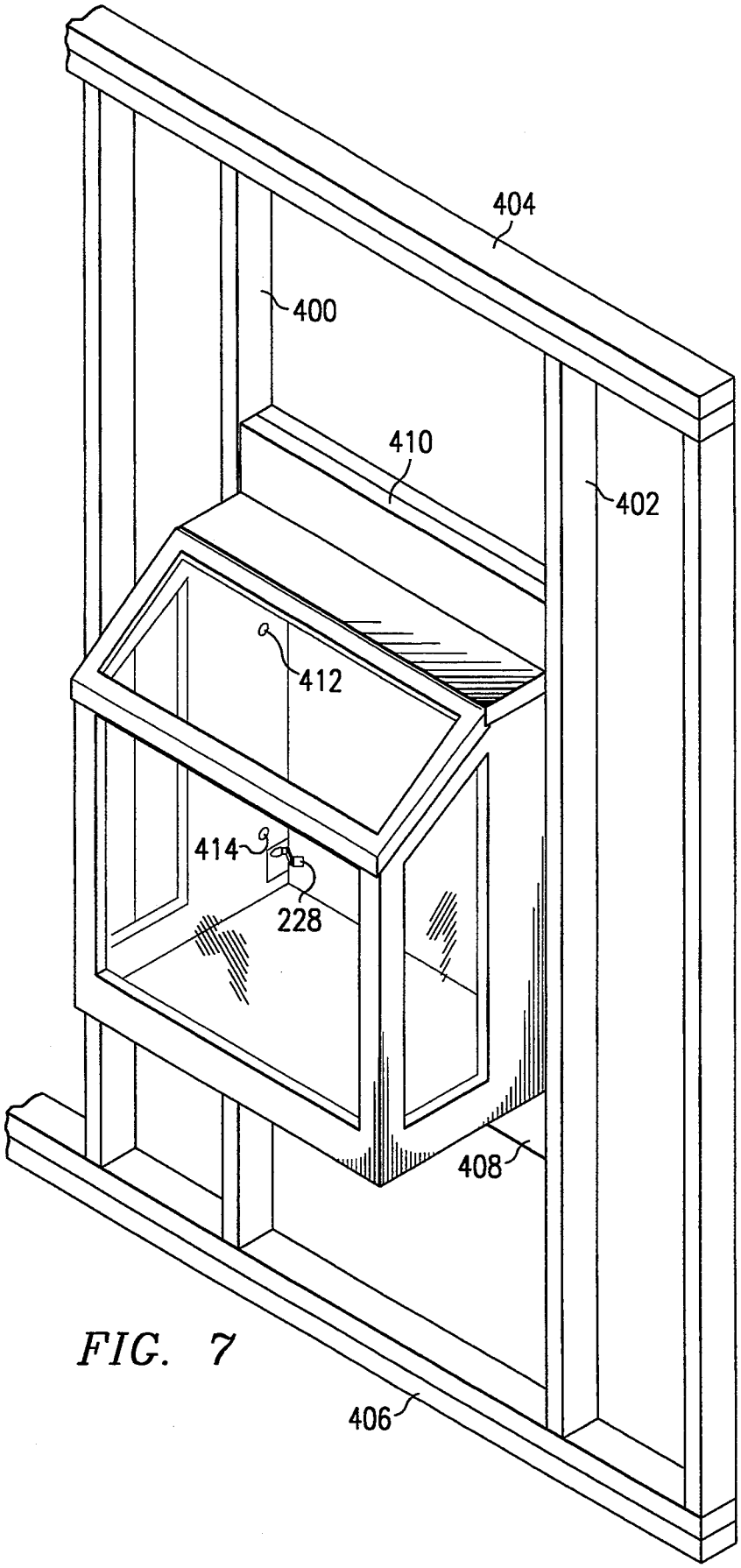
FIG. 7 is a perspective view showing the bay window of FIG. 1 in its installed position relative to wall framing and FIG. 8 shows an alternative bay window installed in accordance with the present invention.

This construction then permits the unique attachment of the bay window in a cantilevered position relative to vertical studs either existing in remodeled structures or conventionally used in new construction. Referring to FIG. 7, in new construction, the wall is prepared for receiving the window by spacing vertical studs 400 and 402 between header 404 and a base plate 406 at a distance that corresponds to the outside dimension of the sidewalls of the window unit. In remodeling construction, the bay window of the present invention is provided in sizes which correspond to openings in which typical windows are installed. Thus, in remodeling applications, the preexisting window is simply removed, exposing the studs to which it is attached. Once the window unit is positioned as shown in FIG. 7, with a lower support 408 and an upper cross member 410 in place, fasteners 412 and 414 are driven through the sidewalls of the bay window into studs 400 and 402. Adjustment may be made by self-adjustment screws or by shimming as necessary to square the unit properly.

Referring to FIG. 7, it will be seen that the present design positions the actuating gear box 226 and crank handle 228 at the interior wall surface, thus eliminating the need for the user to reach into the bay window to operate the movable sash. Further, the present design conceals all of the lift mechanism linkage while at the same time using a shear panel both to strengthen the bay window and to serve as the concealing panel for the linkage. Thus, an extremely clean and aesthetically pleasing appearance is achieved as is shown in FIG. 7. Moreover, an increased glass to wood ratio is achieved.

It will also be noticed that in the design of the present invention, only the fasteners 412 and 414 which pass through sidewall into the confronting faces of vertical studs are needed to mount the unit. Bracing from below is not required. Similarly, cables from above are not necessary to complete the installation. Thus, the installation time is greatly reduced, saving substantial expense. Moreover, because of the manner of attachment used in the present invention, the benefits in using the present unit in remodeling are clearly evident. Specifically, where an old window is to be replaced using the new bay window according to the present invention, siding or facing need not be removed. Only the existing window must be removed, followed by the insertion of the present unit which attaches directly within existing vertical studs.

The relationship of the various lift linkage and actuation assembly is shown in FIG. 3 wherein the pivotable sash is in its closed position and FIG. 4 where it is in its open position. As can be seen in comparing these two positions, the sash is pivoted upwardly by the downward pivoting of crank arm 222 which in turn lowers connecting rod 220, pivots actuation arm 210 and rotates torque bar 160. In turn, lift arms 140 and 142 are raised to pivot pivotable sash 80. The sash is lowered by reverse movement of the crank arm 222.

Another fundamental improvement provided in the present invention is the use of a continuous flexible hinge 300 as the connecting joint between the pivotable sash 80 and top 30. In prior designs, either the top sash is fixed or uses a hinge which generally fails causing moisture and other leakage into the unit. The use of an extruded continuous hinge, such as one made from silicon, is found to provide surprising results. First, where the hinge is made from silicon, it is extremely tough and resilient while being sufficiently flexible to allow the pivoting through the angle of rotation shown in FIGS. 3 and 4. The top of the unit is made weather resistant and fluid tight by the attachment of a vinyl cap 100 which further protects the underlying wood construction and a vinyl covering 102 is also positioned over top 30 to provide further weather resistance.

Therefore, the present invention provides for a completely fluid tight construction while introducing numerous new and innovative features which make the present unit functional, aesthetically appealing and structurally superior. Further, the present design permits the installation of the unit without the need for braces or overhead cables which are necessitated by current designs. In the present invention, the rigidity provided by the structure described above permits the installation of the bay window in a cantilevered position as described. The extensions of the sidewalls which permit this installation, also allows the placement of the actuation mechanism not only in a concealed location, but in a location which is readily accessible to the user from the inside of the room in which the bay window is installed.

Figure 8:
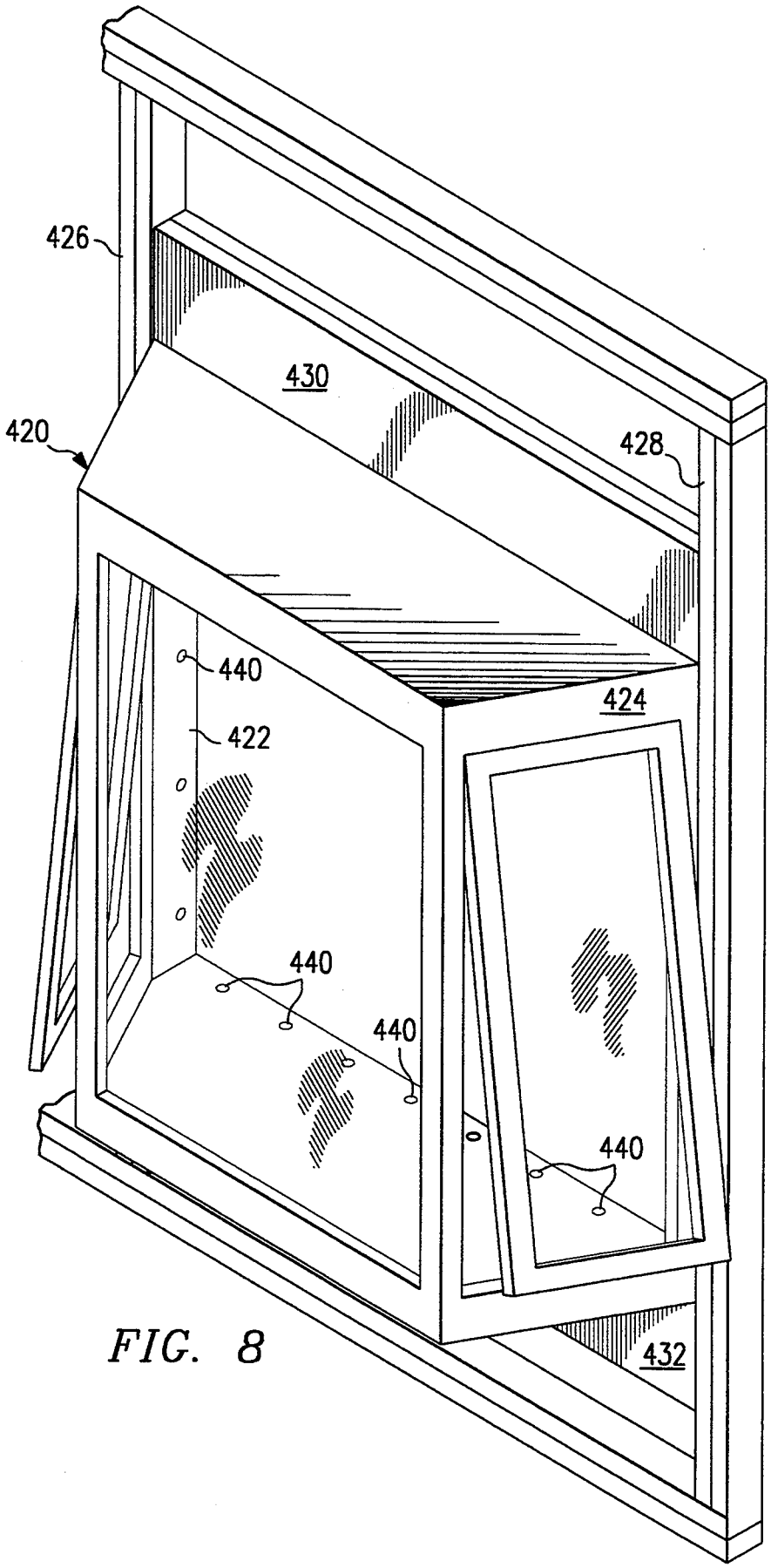

It will be appreciated that the present invention is not limited to the installation of a bay window of any particular design. For example, referring to FIG. 8, a bay window 420, of a different design from bay window 20 shown in FIG. 1, may be installed using the same principles as discussed with regard to FIGS. 1–7. As is shown in FIG. 8, bay window 420 is positioned with its sides 422 and 424 within vertical frame members 426 and 428 and headers 430 and lower supports 432. Bay window 420 is supported thereto by a plurality of fasteners 440 which attach the sidewalls and the bottom and top to these supports.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. For example, the features which permit the installation of the unit by being cantilevered from vertical studs as described may be applied to bay windows of differing designs and thus the invention is not limited to being applied to window units of the size or shape shown in the drawings. Accordingly, the present invention is intended to encompass such rearrangements, modifications and substitutions of parts and elements as fall within the spirit and scope of the invention.

What is claimed is:

1. A window unit for attachment between substantially vertical studs in a wall structure, said studs having confronting faces, comprising:

sidewalls interconnected by a front wall and a top section, said sidewalls having an edge remote from the front wall and arranged for positioning adjacent the confronting faces of the vertical studs such that the sidewalls of the window unit are positioned for mounting therebetween;

a movable sash mounted for movement relative to said sidewalls; and an operating linkage extending from said movable sash and mounted at least partially within one of the sidewalls, said linkage for moving said sash relative to said sidewalls and including an operator controlled mechanism mounted adjacent one of said sidewall edges.

2. The window unit according to claim 1 wherein said linkage comprises:

a crank mechanism for pivoting a crank arm, a connecting rod attached to the crank arm for movement with the crank arm;

an actuation arm having first and second ends with the first end attached to said connecting rod;

a torque bar attached to the second end of the actuation arm;

bearing assemblies mounted to the window unit for receiving the ends of the torque bar;

a pair of lift arms attached to opposite ends of said torque bar; and engagement points on the lift arms for engaging the movable sash to raise and lower the sash.

3. The window unit according to claim 1 further comprising:

a flexible solid, continuous hinge mounted between the movable sash and top section of the window unit.

4. The window unit according to claim 3 where said hinge is made from silicon.

5. The window unit according to claim 3 where said hinge is attached between said movable sash and a mounting rail, said mounting rail being removably attached to the top section of the window unit.

6. The window unit according to claim 1 wherein said linkage comprises:

a torque bar;

bearing assemblies mounted to the window unit for receiving the ends of the torque bar;

a pair of lift arms attached to opposite ends of said torque bar;

engagement points on ends of the lift arms for engaging the movable sash to raise and lower the sash as said lift arms are rotated;

an actuation arm attached to the torque bar;

a crank mechanism for pivoting a crank arm; and a connecting rod attached between the actuation arm and crank arm such that movement of the crank arm causes the movement of the movable sash.

7. The window unit according to claim 6 wherein said connecting rod and crank arm are concealed within one of said sidewalls.

8. The window unit according to claim 1 further comprising:

a glass pane positioned in the sidewalls, each sidewall having upper and lower rails and side rails surrounding said glass pane; and a shear panel comprising a continuous sheet of material overlaying and bonded to the upper and lower rail and side rails.

9. A window unit for mounting to a wall having substantially vertical support structures with confronting faces comprising:

sidewalls interconnected by a front wail and a top section and having edges remote from the front wall, said sidewalls extending from the front wall for insertion between the confronting faces of the vertical support structures to permit the sidewalls to be attached to the confronting faces of the support structures;

a top sash movable relative to the sidewalls; and an operating linkage extending from the movable sash and mounted at least partially within one of the sidewalls, said linkage for moving the sash relative to the sidewalls, said linkage including an operator control mechanism mounted on said one sidewall adjacent the edge of the sidewall remote from the front wail of the window unit.

10. The window unit of claim 9 wherein said movable sash is pivotally attached to the top section.

11. The window unit according to claim 10 wherein said linkage comprises:

a crank mechanism for pivoting a crank arm, a connecting rod attached to the crank arm for movement with the crank arm;

an actuation arm having first and second ends with the first end attached to said connecting rod;

a torque bar attached to the second end of the actuation arm;

bearing assemblies mounted to the window unit for receiving the ends of the torque bar;

a pair of lift arms attached to opposite ends of said torque bar; and engagement points on the lift arms for engaging the pivotable top sash to raise and lower the sash.

12. The window unit according to claim 11 wherein said crank mechanism is positioned at the edge of said one of the sidewalls remote from the front wall.

13. The window unit according to claim 11 wherein said connecting rod and crank arm are completely concealed within said one of the sidewalls.

14. The window unit according to claim 13 further comprising:

a glass pane positioned in the sidewalls, each sidewall having upper and lower rails and side rails surrounding said glass pane; and a shear panel comprising a continuous sheet of material overlaying and bonded to the upper and lower rails and side rails, said shear panel acting to conceal said connecting rod and crank arm.

15. A wood window unit for mounting to a wall structure between substantially vertical supports making up the wall structure, said vertical supports having confronting faces, comprising:

sidewalls interconnected by a front wall and a top;

a glass pane positioned in the sidewalls, each sidewall having upper and lower rails interconnected between side rails to form a frame surrounding said glass pane;

a shear panel comprising a sheet of material overlaying and bonded to the upper and lower rails and side rails of each said sidewall;

a glass pane positioned in the front wall, the front wail having upper and lower rails interconnected between side rails to form a frame surrounding said glass pane; and at least one front wall shear panel section comprising a sheet of material overlaying and bonded to the junction of the front wall upper and lower rails to the front wall side rails, said sidewalls having a mounting portion that has a greater dimension from the sidewall glass pane away from the front wall than from the sidewall glass pane to the front wall such that the window unit may be mounted to the vertical supports with one face of each said sidewall overlying one of the confronting faces of the vertical supports.

* * * * *